United States Patent [19]

Kallmann

[11] 4,420,108

[45] Dec. 13, 1983

[54] APPARATUS FOR THE CONTROLLED FEEDING AND TAKING-OFF OF A THREAD INTO AND OUT OF A THREAD TREATMENT SECTION

[75] Inventor: Jürgen Kallmann, Kaarst, Fed. Rep. of Germany

[73] Assignee: Palitex Project-Company GmbH, Krefeld, Fed. Rep. of Germany

[21] Appl. No.: 266,585

[22] Filed: May 22, 1981

[30] Foreign Application Priority Data

Jun. 20, 1980 [DE] Fed. Rep. of Germany ..... 3023068

[51] Int. Cl.[3] ..... B65H 51/08; B65H 51/30

[52] U.S. Cl. ..... 226/34; 34/152; 226/44; 226/108; 226/118; 226/174; 226/184

[58] Field of Search ..... 226/24, 34, 44, 108, 226/109, 118, 119, 174, 184; 34/23, 56, 148, 151, 152; 28/240, 281

[56] References Cited

U.S. PATENT DOCUMENTS

| | | | |
|---|---|---|---|
| 2,259,715 | 10/1941 | Woolf | 226/184 X |
| 2,539,978 | 1/1951 | Van Dijk | 226/184 X |
| 2,742,143 | 4/1956 | Franklin | 226/184 |
| 2,753,706 | 7/1956 | Franklin | 226/184 X |
| 3,552,622 | 1/1971 | Fransen | 226/184 X |
| 3,874,156 | 4/1975 | Hamby | 28/260 X |
| 3,921,419 | 11/1975 | Rosenkranz et al. | 226/184 X |

FOREIGN PATENT DOCUMENTS

| | | |
|---|---|---|
| 2459239 | 8/1975 | Fed. Rep. of Germany . |
| 689175 | 3/1953 | United Kingdom . |
| 1164852 | 9/1969 | United Kingdom . |

*Primary Examiner*—Stanley N. Gilreath

[57] ABSTRACT

There is described and shown apparatus which is for the controlled feeding and taking-off of a thread 12 into or out of a thread treatment section 2 (for example a heating zone of a heat setting arrangement), and which comprises an externally-driven tapered drive roll 4 upon which bear two tapered counter-pressure rolls 5, 6, whereby the thread 12 can be fed into, and taken-off from, the treatment section 2, using only a single drive means for this feeding and taking-off. The arrangement shown is provided with two thread guide members 9, 10 of fork form, which are swivellable to vary thread tension, one of said guides being swivellable to move the thread engaged between roll 4 and roll 5 along one side of roll 4, and the other of said guides being swivellable to move thread engaged between roll 4 and roll 6 along the other side of roll 4. Swivelling of the one guide member to move thread along roll 4 towards the largest diameter of the roll 4 is accompanied by swivelling of the other guide member to move thread along roll 4 towards the smallest diameter of the roll 4, and vice versa. The members 9, 10 are carried by a common support responsive to a thread tension change at roller 14 to cause both thread engaged between rolls 4, 5, and that engaged between rolls, 4, 6, to move in the same direction along roll 4.

14 Claims, 3 Drawing Figures

APPARATUS FOR THE CONTROLLED FEEDING AND TAKING-OFF OF A THREAD INTO AND OUT OF A THREAD TREATMENT SECTION

BACKGROUND, OBJECTIVES AND SUMMARY OF THE INVENTION

The invention relates to an apparatus for the controlled feeding and taking-off of a thread into or out of a thread treatment section. There is described herein apparatus, for the controlled feeding and taking-off of a thread into or out of a thread treatment section, with delivery means provided in front and behind the thread treatment section, which delivery means comprise tapered rolls the peripheries of which bear upon one another along surface lines, and a thread guide member which can be moved to and fro along a thread drawing-in gap formed between the tapered rolls.

The apparatus of this invention serves to let the thread pass through a thread treatment section, such as, for example, the heating zone of an arrangement for a thermal treatment of a thread or the heat-setting of a thread, in a controlled or differential tension state, more especially when length or tension variations are produced either by the thread treatment as such, or when particular length or tension variations are required to be achieved during such thread treatment. Thus, for example, British Patent Specification No. 689 175 contains a description of a heat setting arrangement in the form of an elongated heating zone through which the thread is passed, to which independently controllable thread delivery means are assigned both at the inlet and outlet in order to be able to pass the thread in a given tension state through the heating zone as a function of set delivery speeds of the delivery means. Separate drive units or drive transmission members and separately operating regulating or control arrangements are required for the two delivery means in the case of this known apparatus in which the delivery means comprise substantially cylindrical delivery rolls or rollers.

There is described in British Patent Specification No. 1164852 a delivery means provided ahead of a thread treatment section, which means comprises a tapered drive roll driven from outside and a tapered counter-pressure roll pressed by spring force to bear upon this tapered drive roll. A thread guide member is assigned to these tapered delivery rolls, which member can be moved to and fro along a drawing-in gap between the two tapered rolls. When this thread guide member is moved in a direction towards the largest diameter of the two tapered rolls this thread guide member takes along the thread passing through the drawing-in gap, as a result of which action the thread is shifted into the range of higher peripheral speeds so that the thread running speed is also raised. On movement of the thread guide member in a direction towards the smallest diameter of the tapered rolls it is similarly possible to reduce the thread running speed. The control of the thread guiding member is effected by a regulating or control member which responds to the tension of the thread passing through the thread treatment section.

German Pat. No. 24 59 239 deals with a delivery means of similar design and a similar mode of operation, in conjunction with a heat setting arrangement in the form of a heating tube through which a thread requiring treatment is required to pass through in a substantially tension-free state.

An object of the invention is to provide a simply-designed apparatus for the controlled feeding and taking-off of a thread into and out of a thread treatment section through which the thread is required to pass in a controlled tensioned state, whereby only one common drive roll is necessary for the delivery means both ahead and behind the thread treatment section, whilst there is provided the facility for setting and maintaining a preset differential tension state within the thread treatment section, such as for example a heat-setting section.

According to the invention, there is provided apparatus for the controlled feeding and taking-off of a thread into or out of a thread treatment section, with delivery means ahead of and behind the thread treatment section, which delivery means comprise tapered rolls, bearing upon one another along surface lines, and a thread guide member which is movable to and fro along a thread drawing-in gap formed between the tapered rolls, characterized in that for forming feeding-in delivery means and take-off delivery means two tapered counter-pressure rolls are assigned to a tapered drive roll which can be driven from outside, and in that two thread guide members are disposed in front of or behind the respective drawing-in gaps between the tapered drive roll and the tapered counter-pressure rolls.

For the case in which the running-in and running-out thread portions in the drawing-in gaps between the tapered rolls are exactly opposite to one another it is safeguarded that within the thread treatment section, such as for example a heating section, the thread feeding-in speed equals the thread-take-off or thread drawing-off speed, so that such a thread is exposed to the relevant treatment in the thread treatment section without additional tensioning during the relevant treatment.

When it is, however, required for a thread to be, for example, additionally tensioned within the treatment section, the two thread guide members may be reset in such a way that the thread entering the treatment section is moved towards the smallest diameter of the tapered rolls and the thread leaving the treatment sections is moved towards the largest diameter of the tapered rolls, as a result of which the inlet speed of the thread becomes slower than its drawing-off speed. This results in the thread experiencing a stretching action in the treatment section, such as for example a heating zone. Through a swivelling of the two thread guide members in an opposite direction it is similarly possible to raise the inlet speed of the thread relatively to its drawing-off speed.

The axes of the tapered drive roll and of the two tapered counter-pressure rolls are preferably in a common plane, with the thread guide members disposed one at each side of this axis plane.

Preferably, in order to require only a single control or regulating arrangement, the two thread guide members may be fixed on a common rotatably-mounted supporting or holding means.

In order to safeguard a central running in of the thread into the respective drawing-in gap for every swivel setting of swivellable thread guide members, said thread guide members are preferably in the form of thread guide forks.

The aforesaid rotatably-mounted supporting or holding means is preferably arranged and the thread guide members are preferably formed such that, on resetting of the one thread guide member in a direction towards the largest diameter of the tapered drive roll the other thread guide member is moved in a direction towards the smallest diameter of the tapered drive roll.

To apparatus constructed in accordance with the invention, there is preferably assigned a deflector roller which is used for forming a thread loop between the two drawing-in gaps whereby these thread loops as a whole, or only one of its two loop limbs, are lead through the thread treatment zone, consisting for example of a heating zone.

The thread fed into, and pulled out again from, a thread treatment section, such as for example a heating zone, by delivery means constructed in accordance with the invention may come from any kind of yarn feed or also from some other processing station. The thread leaving the thread treatment section is as a rule led to a winding arrangement. The necessarily occurring speed differences and/or slip conditions within the winding arrangement and also a taking up onto bobbin elements of e.g. coned shape, cause the setting up of an imbalance between fed-in and wound-off thread. This irregularity may be the cause of different thread tensions between the run-out from a delivery means constructed in accordance with the invention and the winding arrangement. In order to eliminate such thread tension variations in this zone and also to permit generally adaptation to any timewise slowly variable processing speed, the foresaid common rotatably-mounted supporting or holding means for the thread guide members may be so supported that it can be shiftable in the axial direction of the tapered drive roll. This feature provides the possibility of, for example, shifting the rotatably-mounted supporting or holding means, and thereby the two thread guide members, in directions towards the largest diameters of the tapered rolls when the thread tension increases between the run-out from the delivery means constructed in accordance with the invention and a winding arrangement as a result of which the overall thread running speed is raised and thereby the increase in thread tension ahead of the winding arrangement is counteracted without affecting differential conditions of the thread speed in the thread treatment section.

Also, according to the invention, there is provided apparatus for the controlled feeding and taking-off of a thread into or out of a thread treatment section, said apparatus comprising: (a) an externally-drivable tapered drive roll and two tapered counter-pressure rolls bearing upon the drive roll, the thread travelling to the thread treatment section engaging between the drive roll and the one counter-pressure roll, and the thread travelling away from the thread treatment section engaging between the drive roll and the second counter-pressure roll; and (b) thread guide means movable to cause, to vary thread tension, movement of thread along the tapered drive roll.

BRIEF DESCRIPTION OF THE DRAWINGS

In the accompanying drawings, which show, by way of example, an embodiment of the invention.

DETAILED DESCRIPTION OF PREFERRED EMBODIMENT OF THE INVENTION

Figure 1:
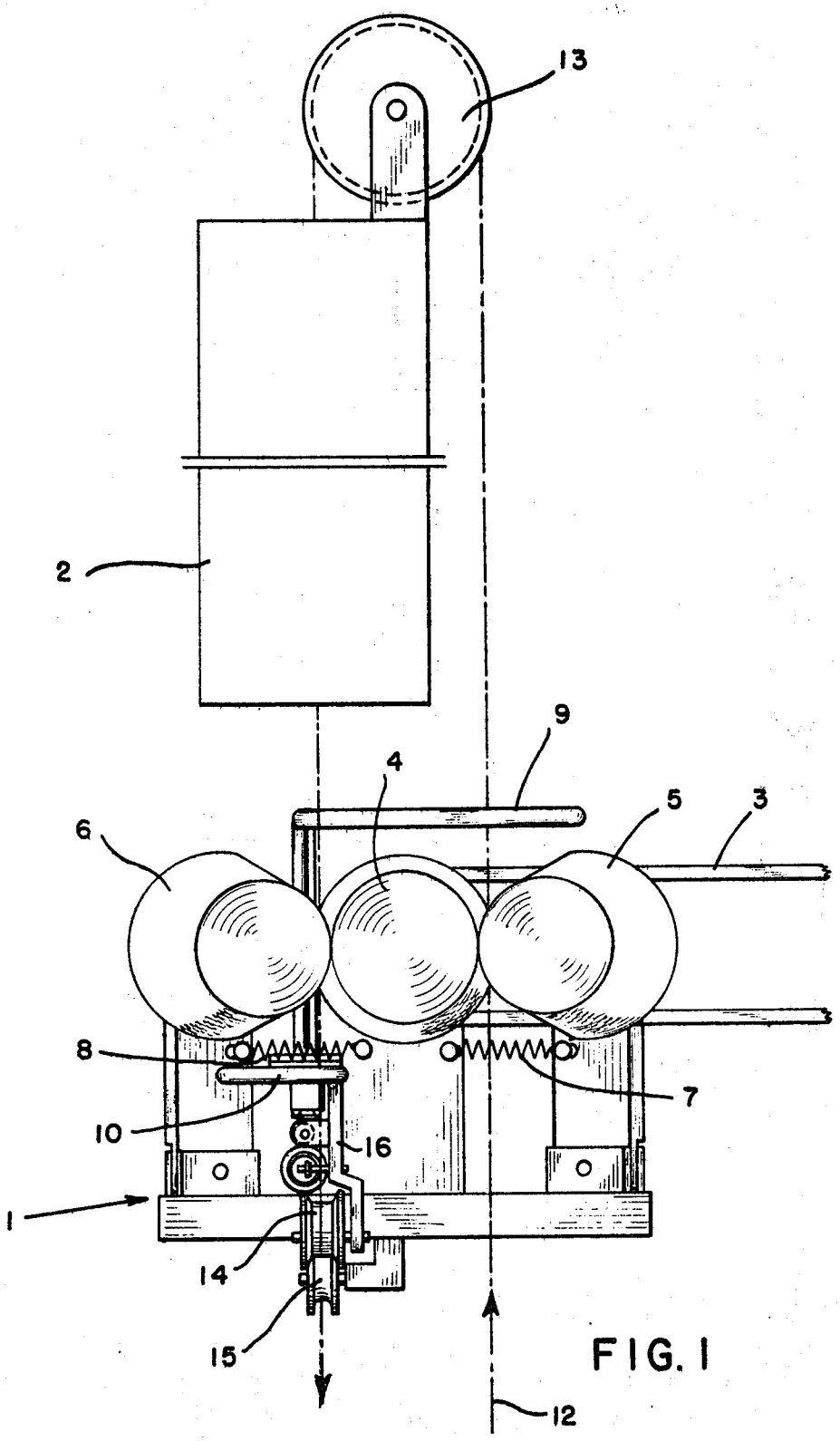
FIG. 1 is a diagrammatic drawing illustrating front elevation of a delivery arrangement, constructed in accordance with the invention, in conjunction with a thread treatment section assigned to it.
Figure 2:
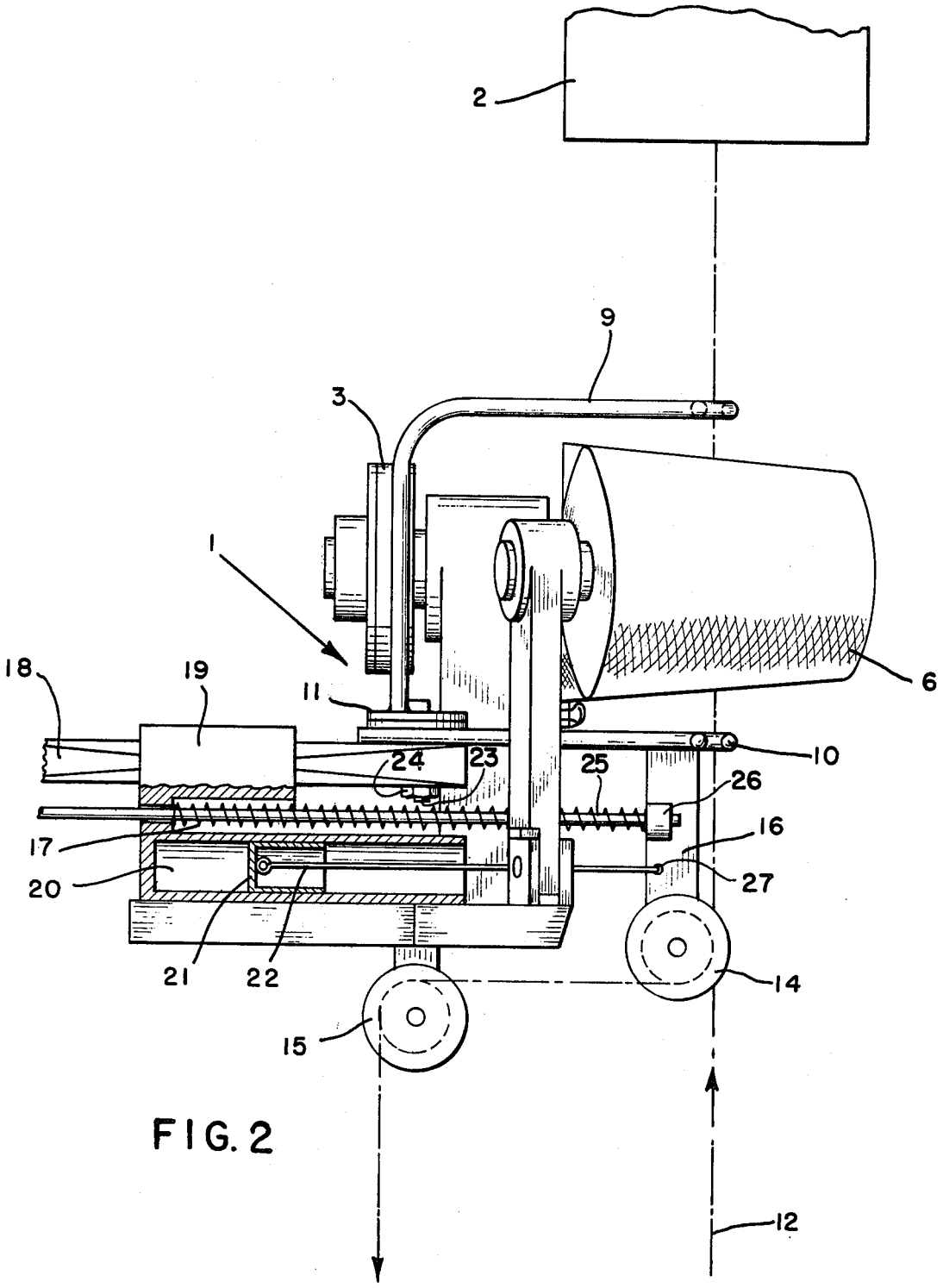
FIG. 2 is a diagrammatic drawing on a larger scale, partially in section, illustrating in side elevation, the delivery arrangement shown in FIG. 1.

Referring to the drawings, there is assigned to a thread delivery arrangement 1 a thread treatment section 2, comprising, for example, a heating zone of a heat-setting arrangement.

Figure 3:
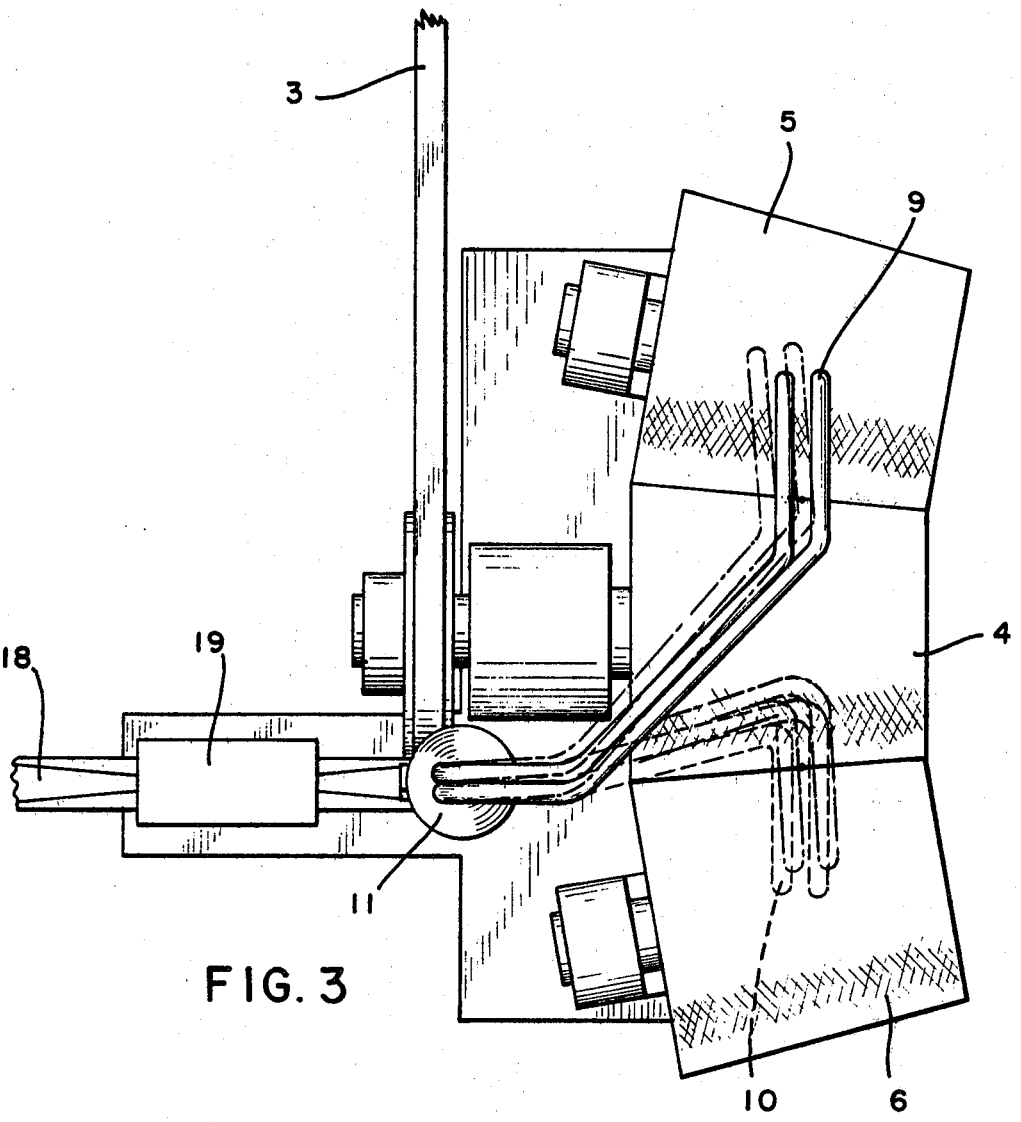
FIG. 3 is a plan view of the delivery arrangement shown in FIG. 1.

The thread delivery arrangement 1 comprises a tapered drive roll 4, which can be driven by means of a drive belt 3, and two tapered counter-pressure rolls 5 and 6 which are swivel mounted and are pressed by means of respective springs 7 and 8 to bear upon the centrally-arranged tapered drive roll 4. For guiding the thread along the drawing-in gaps between the tapered drive roll 4 and the tapered counter-pressure roll 5 (feed delivery means) on one hand and the tapered drive roll 4 and the tapered counter-pressure roll 6 (take-off delivery means) on the other hand are thread guide members 9 and 10, respectively, which both have the shape of thread guide forks (see specifically FIG. 3). The two thread guide members 9 and 10 are mounted on a common rotatably-mounted support or holder 11 which by means of a control or regulating member, not shown, can be moved to execute a restricted rotary motion such that the fork-shaped thread guide members 9 and 10 can be respectively swivelled or reset from the two settings shown in solid and broken lines into the respective settings shown in dash-dotted lines and vice-versa. Rotatable holder 11 is releasably secured in position by means of the threaded stud 23 which extends through the thrust rod 18 to threadably receive the securing nut 24 thereon. Releasing nut 24 permits swiveling of the guide members 9 and 10 to various positions as illustrated in FIG. 3.

The thread 12 running, in the direction of the arrow, between the tapered rolls 4 and 5 passes in the zone of the drawing-in gap through the fork shape thread guide member 9 and from there up to a deflection roller 13 disposed at the top end of the thread treatment section 2 and after deflection by this deflector roller 13 it passes downwards through the thread treatment section 2 to the drawing-in gap in between the tapered rolls 4 and 6 of the take-off delivery means and subsequently through the thread guide member 10 assigned to this drawing-in gap to which thread guide member 10 a roller holder 16 is securely suspended to support thread deflector roller 14. Beyond this thread guide member 10 the thread is passed by means of further thread deflector rolls 14 and 15 to a winding arrangement, not shown.

The rotatably-mounted support or holder 11 is arranged and the thread guide members 9, 10 are formed such that, on resetting of the one thread guide member upon loosening securing nut 24, in the direction of the maximum diameter of the tapered drive roll 4 the other thread guide member is displaced in a direction towards the smallest diameter of this tapered drive roll.

The deflector roller 13 mounted at the top of the thread treatment section 2 is of a diameter which equals substantially the mean diameter of the tapered drive roll 4 and the axis of which is coplanar with the axis of the tapered drive roll. This roller 13 is dimensioned and mounted so that the tangents lying opposite to one another in the zone of the mean diameter line of the tapered drive roll 4 and passing through the drawing-in gaps are located in two opposite tangential planes of the deflector roller such that the thread 12 is lead from the drawing-in gap between the rolls 4, 5 substantially in a straight line upwards and, after forming a loop is lead again in a straight line downwards through the thread treatment section 2. The axes of the tapered rolls 4, 5 and 6 are located in a common horizontal plane.

For the case where the portions of the in- and outcoming thread 12 in the drawing-in gaps between the tapered rolls 4, 5, 6 are precisely opposite to one another it is safeguarded that the thread is passed with identical feed-in speed and take-off speed through the thread treatment section 2, consisting for example of a heating zone. Such a thread will be subjected inside the thread treatment section 2 to a thermal treatment, as an example, without any additional stretching. The normal requirement is, however, that the thread has to be subject to given thread tension conditions inside the treatment section with the object of safeguarding a desired elongation or an appropriate residual shrinkage. For effecting a variation in the tension state of the thread passing through the thread treatment section 2 it is possible to reset through turning of the support or holder 11 the two fork-shaped thread guide members 9, 10 along the drawing-in gaps between the tapered rolls.

In order, for instance, to increase the state of tension of the thread inside the thread treatment section 2, the thread guide members 9, 10 are swivelled or rotated about their axes when securing nut 24 is loosened on threaded stud 23 so that the thread entering in between the tapered drive roll 4 and the tapered counter-pressure roll 5 (feed-in delivery means) is moved towards the smallest diameter of the tapered rolls while the thread emerging from the drawing-in gap between the tapered drive roll 4 and the tapered counter-pressure roll 6 moves towards the largest diameter of the tapered rolls. This causes the inlet speed of the thread to become smaller than its take-off speed, so that the thread is stretched in the thread treatment section 2 while being simultaneously subjected to a thermal treatment.

The thread guide members 9 and 10 may respectively be disposed either in front or behind the respective drawing-in gaps.

So far there has been described a first regulating stage of the thread delivery means in order to obtain a differential tensioned state of the thread passing through the thread treatment section. This differential tensioned state may be set prior to the operation of the unit, but may, however, in addition be regulated continuously through continuous action upon the support or holder 11 for the two thread guide members 9, 10 by a regulating or control means which in conventional known manner scans the tensioned state of the thread ahead of or inside the thread treatment section 2.

The thread being introduced into, and emerging again from, the thread treatment section 2 by means of the thread delivery arrangement may come from any desired feed or some other processing station in advance. The thread treated in the yarn treatment section 2 and emerging from the thread delivery arrangement is fed to a take-up bobbin arrangement which may be either part of a machine unit in which is also accommodated the thread treatment section 2 or be alternatively a separate coiling arrangement which is independent from the machine.

Due to the slip conditions which are bound to occur within the winding arrangement and also on taking up by e.g. conical coiling members, there is set up an imbalance between the thread being fed into the thread delivery arrangement 1, and the thread which has to be taken up by the winding arrangement. This irregularity may be the cause of different thread tensions which may however be equalized or compensated by means of the thread deflector roller 14 following on after the thread guide member 10. Any thread tension building up between the said thread delivery arrangement and some following-on winding arrangement may be utilized via this thread deflector roller 14 directly as regulating pulse. This is effected through an action such that on increase in the thread tension a roller holder 16 carrying the thread deflector roller 14 acts, against the pressure from a spring 17 mounted on the spring guide rod 25 one end of which is secured at the boss 26 to holder 16, directly upon the thread guide member 10 or the support or holder 11 such that this support or holder together with the two thread guide members 9 and 10 is displaced in the axial direction of the tapered drive roll 4. In the event of an increase in thread tension the support or holder 11 and the thread guide members 9 and 10 are displaced in a direction towards the largest diameters of the tapered rolls, which leads on one hand to an increase in the thread travelling speed without causing on the other hand a variation in the differential ratio of the thread speed inside the thread treatment section 2 which ratio is a function of the swivel setting of the two thread guide members 9 and 10.

The support or holder 11 is mounted on a polygonal cross-section thrust rod 18 which is held in a guide block 19 such as to be shiftable horizontally.

In order to render this regulating means independent of inadvertent momentary thread tension variations there is assigned to the roller holder 16 a pneumatic damping cylinder 20 to act as time-lag means. In this cylinder there is guided a piston 21 which is linked through a piston rod 22 with the roller holder 16 through opening 27 in holder 16.

I claim:

1. Apparatus for the controlled thread feeding into an incoming thread section and withdrawing of a thread from a thread outgoing section for passage into and out of a thread treatment section, said apparatus comprising; an externally drivable tapered surface drive roll and first and second tapered counter-pressure rolls bearing upon said tapered surface drive roll from opposite sides thereof defining with the latter a first gap or nip forming a feeding-in delivery means for said incoming thread section and a second gap or nip forming a take-off delivery means for said outgoing thread section, said thread travelling to said thread treatment section engaging between the drive roll and said first counter-pressure roll, said thread travelling away from said thread treatment section engaging between said drive roll and said second counter-pressure roll, and first and second movable thread guide members for moving said thread along said tapered surface of said drive roll in response to variations in thread tension.

2. Apparatus according to claim 1, wherein said thread guide members comprise swivellable thread guide members, one of said swivellable members to move thread engaged between said tapered drive roll and said first tapered counter-pressure roll along said side of said tapered drive roll contiguous with said first tapered counter-pressure roll, the second swivellable guide member to move thread engaged between the said tapered drive roll and said second counter-pressure roll along said tapered drive roll contiguous with said second tapered counter-pressure roll.

3. Apparatus according to claim 2, and a common supporting means movable, in response to a change in the tension of the thread after it has passed between said drive roll and the second counter-pressure roll, to cause, through the thread guide members, both thread engaged between the drive roll and said first counter-pressure roll, and thread engaged between the drive roll and said second counter-pressure roll, to move in the same direction along the drive roll, and said two swivellable thread guide members carried by said common supporting means.

4. Apparatus in accordance with claim 1, wherein the axes of said tapered drive roll and of said two tapered counter-pressure rolls are disposed in a common plane and said thread guide members are located one at each side of said common plane.

5. Apparatus in accordance with claim 4, wherein said thread guide members are fixed on a common rotatably mounted supporting means.

6. Apparatus in accordance with claim 5, wherein said thread guide members have the shape of thread guide forks.

7. Apparatus in accordance with claim 5 and a regulating and settling member connected to the rotatably-mounted supporting means.

8. Apparatus in accordance with claim 5 said rotatably supporting means being arranged whereby said thread guide members are so shaped that, on a resetting of one of said thread guide members in a direction towards the largest diameter of said tapered drive roll the other said thread guide member is moved in a direction towards the smallest diameter of said tapered drive roll.

9. Apparatus in accordance with claim 1, and a deflector roller for deflecting thread during its course between said feeding-in delivery means and the take-off delivery means, the diameter of said deflector roller equals substantially the mean diameter of said tapered drive roll and the axis of which is co-planar with the axis of the tapered drive roll such that tangents lying opposite to one another in the zone of this mean diameter line of the said drive roll and passing through the first gap is located in two mutually-facing tangential planes of the deflector roller.

10. Apparatus in accordance with claim 9, and a common supporting means for said first and second thread guide members so supported that it can be shifted in the axial direction of said tapered drive roll.

11. Apparatus in accordance with claim 10, and a thread deflector roller which, viewed in the direction of travel of the thread, is disposed behind said drawing-in gap between said tapered drive roll and said tapered counter-pressure roll of said take-off delivery means and also behind one of said thread guide members, said thread guide member being aligned with said take-off delivery means.

12. Apparatus in accordance with claim 11, and a roller holder having a spring-load in the axial direction of said tapered drive rollers, and a pneumatic damping cylinder acting as a time lag means mounted on said holder, and said thread deflector roller supported on said roller holder.

13. Apparatus in accordance with claim 12, and a polygonal cross-section thrust rod in juxtaposition to said supporting means whereby said supporting means may be shifted by said thrust rod.

14. Apparatus in accordance with claim 1 and a thread-treatment section forming a heat-setting apparatus.

* * * * *